US006232889B1

(12) United States Patent
Apitz et al.

(10) Patent No.: US 6,232,889 B1
(45) Date of Patent: May 15, 2001

(54) SYSTEM AND METHOD FOR SIGNAL LIGHT PREEMPTION AND VEHICLE TRACKING

(76) Inventors: Peter Apitz, 2248 Hartford Ave., Fullerton, CA (US) 92831; Emery B. Dyer, 2051 Evelyn's Dr., Hollister, CA (US) 95023

( * ) Notice: Subject to any disclaimer, the term of this patent is extended or adjusted under 35 U.S.C. 154(b) by 0 days.

(21) Appl. No.: 09/368,736

(22) Filed: Aug. 5, 1999

(51) Int. Cl.[7] ..... G08G 1/07
(52) U.S. Cl. ..... 340/906; 340/902; 340/907
(58) Field of Search ..... 340/902, 906, 340/907, 904, 916, 933, 935, 988, 990, 917; 701/117, 213, 225

(56) References Cited

U.S. PATENT DOCUMENTS 3,789,198 * 1/1974 Henson et al. ..... 340/990
4,750,197 * 6/1988 Denekamp et al. ..... 340/825.35
4,919,434 4/1990 Morgan et al. ..... 340/906
5,539,398 * 7/1996 Hall et al. ..... 340/907
5,890,682 * 4/1999 Welk ..... 340/903

* cited by examiner

*Primary Examiner*—Van T. Trieu

(57) ABSTRACT

A system and method is provided for preempting the signal lights of an intersection. A magnetic heading of an emergency or other vehicle is measured using a mobile unit and adjusted to account for the magnetic interference of the vehicle. The magnetic heading is transmitted to a base unit installed at the intersection. Upon receiving a verified magnetic heading from a vehicle, the base unit preempts the normal operation of the signal lights to present a green light or other preferred display to the emergency vehicle Additionally the vehicle has a transmitter operating at a high frequency, which limits the range of the transmission. Thus, only the intersection to be preempted receives the transmission from the mobile unit. Also, a tester is provided to evaluate the function of the base unit and the mobile unit without interfering with the normal operation of the traffic signal. Also, the location, type and direction of other vehicles can be tracked even if the signal lights are not preempted.

54 Claims, 3 Drawing Sheets

SYSTEM AND METHOD FOR SIGNAL LIGHT PREEMPTION AND VEHICLE TRACKING

BACKGROUND OF THE INVENTION

1. Field of the Invention

The present invention relates to systems and methods for preempting traffic signals. More particularly, the present invention relates to systems and methods allowing emergency and other vehicles to control or preempt traffic signals.

2. Present State of the Art

Cities and communities are in a continual state of change. Some communities are experiencing tremendous growth, while others are attempting to attract new businesses. Additionally, each city or community is faced with a variety of problems including the problem of developing an adequate transportation system.

The scope of the transportation system is quite broad and includes topics from road construction to mass transit. One primary concern of the transportation system is the road or street system, which must be capable of handling the traffic of a community. Practically all drivers are aware of the delays caused by rush hour, construction, and signal lights. These delays can cause many problems for everyone, especially emergency vehicles.

In addition to the delays, there are different types of roads which have distinct purposes. Main roads are designed to handle large volumes of traffic, while roads built in the suburbs and residential neighborhoods, on the other hand, are different in that they are designed for slow careful driving. In short, the roads of a community are built with a variety of different concerns and purposes in mind.

Regardless of how the roads are built, the traffic on those roads must be controlled, and one method of controlling the traffic on the roads and streets of a community is to use signal lights. Many signal lights are designed with a timing mechanism. With timed signal lights, vehicles wait a certain amount of time before they are presented with a green light, at which point they proceed through an intersection. At intersections with timed signal lights, it is possible for a vehicle to be the only vehicle at the intersection, yet the vehicle must wait for the timer to expire before the signal light presents them with a green light Today, many signal lights are being replaced or upgraded and have the ability to sense the presence of a vehicle. The advantage of these signal lights is that they can respond to actual traffic conditions. For example, at a signal light with a turn signal, the traffic light can sense when there are no more vehicles turning. When this condition is sensed, the turn signal is deactivated while other lights are activated so that other vehicles, which were waiting to enter the intersection, may proceed.

While these signal lights have improved the control and the flow of traffic, they cannot respond effectively to emergency vehicles which may need to cross or enter the intersection immediately. As a result, an emergency and other vehicles may be delayed behind traffic while waiting for the light to change.

There are many instances where it is imperative that an emergency vehicle proceed through an intersection quickly. In many accidents, time is critical and an ambulance that has green lights at intersections will be able to arrive much quicker. Police cars involved in high speed chases can prevent potentially fatal injuries by controlling the intersections through which the chase is occurring. Police cars will also be able to arrive at crime scenes faster. If the lights of an intersection are controlled or preempted, persons not hearing the sirens of an emergency vehicle are prevented from entering the intersection being preempted. In short, the public can greatly benefit by permitting emergency or other approved vehicles to control or preempt signal lights.

Several attempts have been made to address this issue. One method includes the use of optical devices to transmit the message that a vehicle is requesting a light change or preemption. This method requires that an optical device be mounted on each signal mast for each direction. This can be quite expensive and requires that the optical device and the corresponding emergency vehicle be able to see each other. Other systems employ the use of global positioning technology. This method has significant drawbacks, even though it may be effective. For instance, the system requires extensive programming, not only for the emergency vehicles, but also for the location of each intersection. Also, the position of the vehicle must constantly be reevaluated. Other methods require that a highly directional transmit or receive antenna be mounted for each direction of travel in addition to the transmit antenna in the vehicle.

OBJECT AND SUMMARY OF THE INVENTION

It is therefore an object of one embodiment of the present invention to discriminate the direction of travel of a vehicle.

It is another object of one embodiment of the present invention to preempt the normal operation of a signal light.

It is a further object of one embodiment of the present invention to allow emergency vehicles to preempt signal lights.

It is an additional object of one embodiment of the present invention to permit emergency and other types of vehicles to navigate intersections more easily.

It is yet another object of one embodiment of the present invention to permit other types of vehicles, such as mass transit vehicles, to preempt signal lights.

It is a further object of one embodiment of the present invention to control the operation of signal lights at an intersection.

In summary, the present invention assists emergency and other vehicles to proceed through an intersection quickly and easily by preempting the signal lights of an intersection. This is accomplished in one embodiment by installing a base unit at each intersection to be controlled and preempted. The base unit connects to the signal light in a manner that permits the controller to control which lights are green and which lights are red when an emergency vehicle needs to proceed through the intersection. More specifically, the base unit provides a group of control signals which may be used to decide which lights should be green and which lights should be red. The use of the control signals by the signal lights is a decision made by the relevant authority. In one embodiment, a green light is presented to the operator of the emergency vehicle when an appropriate signal is received from an emergency or other vehicle. In another embodiment, all signal lights are turned red when an appropriate signal is received from an emergency or other vehicle. In other words, the status of the signal lights depends in part on: the type of vehicle seeking to preempt the signal lights; and how the relevant authority desires the signal lights to respond to the control signals.

The signal sent to the base unit at the intersection is generated by a mobile unit, which is located in each vehicle which needs the capability to preempt or control signal lights. The mobile unit determines the direction of travel of the vehicle by measuring the magnetic heading. This heading is transmitted to the base unit, where it is processed to take into account the physical orientation of the intersection. Next, the base unit produces output signals which permit the normal operation of the signal lights to be controlled such that the signal lights are preempted by the vehicle and a green light is presented to the vehicle.

The transmission of the magnetic heading to the base unit is accomplished using a transmitter operating at a high frequency. The high frequency and controlled attenuation of the transmitted signal essentially limits the range of the transmission such that only the intersection that the vehicle is approaching and will be passing through is preempted by the vehicle. However, the range of the transmission can be extended or shortened as needed. In this manner, an emergency or other vehicle can more easily pass through intersections without interrupting the traffic flow at other intersections.

The present invention is not limited to emergency vehicles. Other types of vehicles can also preempt signal lights, if they are permitted to do so by the relevant authority. Alternatively, the present invention can be use as a tracking mechanism. For instance, the system can be used to track the location of the mass transit vehicles of a city. As a mass transit vehicle approaches an intersection, the mobile unit will transfer to the base unit, in one embodiment, the type of vehicle, the direction of travel of the vehicle and the vehicle identification. The base unit, upon receiving the information, will make this information available to be transmitted or sent along with the location of the intersection to dispatch or other remote location. In this manner, the mass transit vehicles of a city can be effectively monitored and tracked. Similarly, the system of the present invention can be adapted to the requirements of other types of vehicles.

Additional objects and advantages of the present invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The overall design of the present invention is to allow emergency or other vehicles to preempt signal lights. The discussion is directed at emergency vehicles, but other vehicles, including but not limited to buses, taxis, police cars, authorized vehicles and mass transit vehicles, may utilize the present invention. The use of an emergency vehicle is intended to be exemplary rather than exclusive.

As used herein, preempt or control signal lights indicates the process of interrupting the normal operation of the signal lights at an intersection such that the emergency vehicle is permitted to proceed through the intersection. In many instances, this is accomplished by presenting the emergency vehicle with a green light and causing the other lights to be red such that no other vehicle enters the intersection. Preempt or control signal lights also refers to the ability to electrically interact with or override the existing signals which control the operation of the signal lights. Preempt or control signal lights further refers to providing control signals to the signal lights which are used as dictated by the relevant authority.

This system has several advantages. The system does not have to rely on directional antennas and extensive programming because the effective range of the transmitter will only affect one intersection at a time. The direction of travel is known by the magnetic heading which is repeatedly computed. The affected intersection responds to the magnetic heading by preempting the signal lights and providing the emergency vehicle a green light. Once the emergency vehicle has cleared the intersection, the signal lights revert to their normal function. The system can be tested without interrupting the flow of traffic and can be easily installed at some or all intersections.

Figure 1:
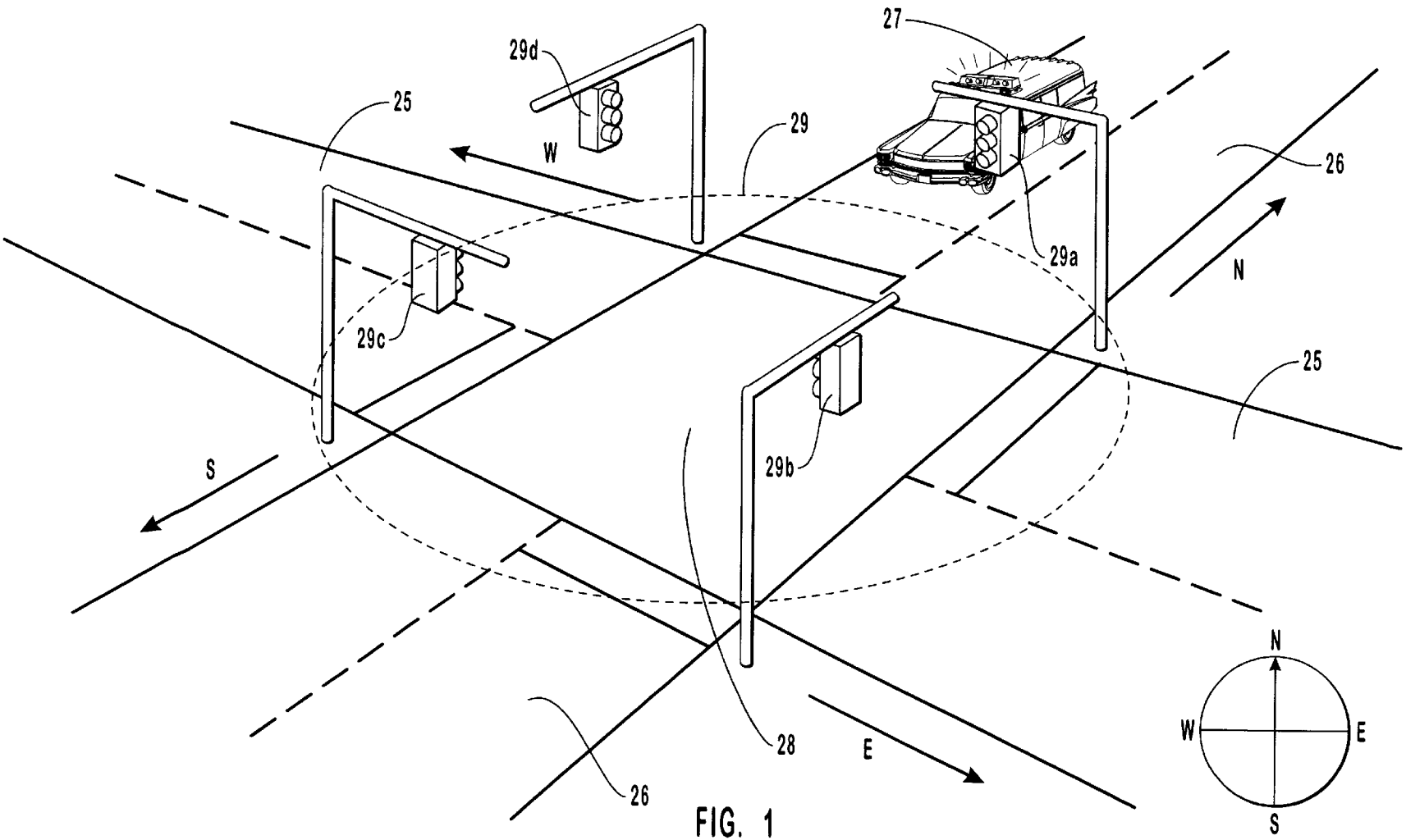
FIG. 1 is an illustration of a typical intersection which has signal lights controlling the flow of traffic.

FIG. 1 is an illustration of a typical intersection and comprises signal lights 29, road 26 and road 25. Road 26 and road 25 can run in any direction, but road 26 is illustrated as running North and South and road 25 is illustrated as running East and West in FIG. 1. Signal lights 29 control intersection 28 and are typically programmed to permit an orderly traffic flow through intersection 28 in manners well known in the art. Vehicle 27 is intended to represent a vehicle which has a need to proceed through intersection 28 as soon as possible. Vehicle 27 may be a police car, a fire engine, an ambulance, or any other type of vehicle which has the capability to preempt signal lights 29.

When vehicle 27 has a need to proceed through intersection 28, signal lights 29 are controlled or preempted by vehicle 27 such that vehicle 27 may more easily proceed through intersection 28. If vehicle 27 is traveling South on road 26, then signal lights 29 will be controlled by vehicle 27 accordingly. In other words, because vehicle 27 as illustrated in FIG. 1, is traveling South, signal light 29*c* is preempted and made green, while signal lights, 29*a*, 29*b*, and 29*d* are also preempted and made red. In this manner, vehicle 27 controls signal lights 29 and may more rapidly proceed through intersection 28 and either continue traveling on road 26 or turn and travel on road 25. The preemption or control of signal lights 29 is preferably implemented according to a preset signal order which is defined by the relevant authority or authorized personnel. Therefore, when a preemption signal is received, the signal lights respond in a prescribed manner.

Figure 2:
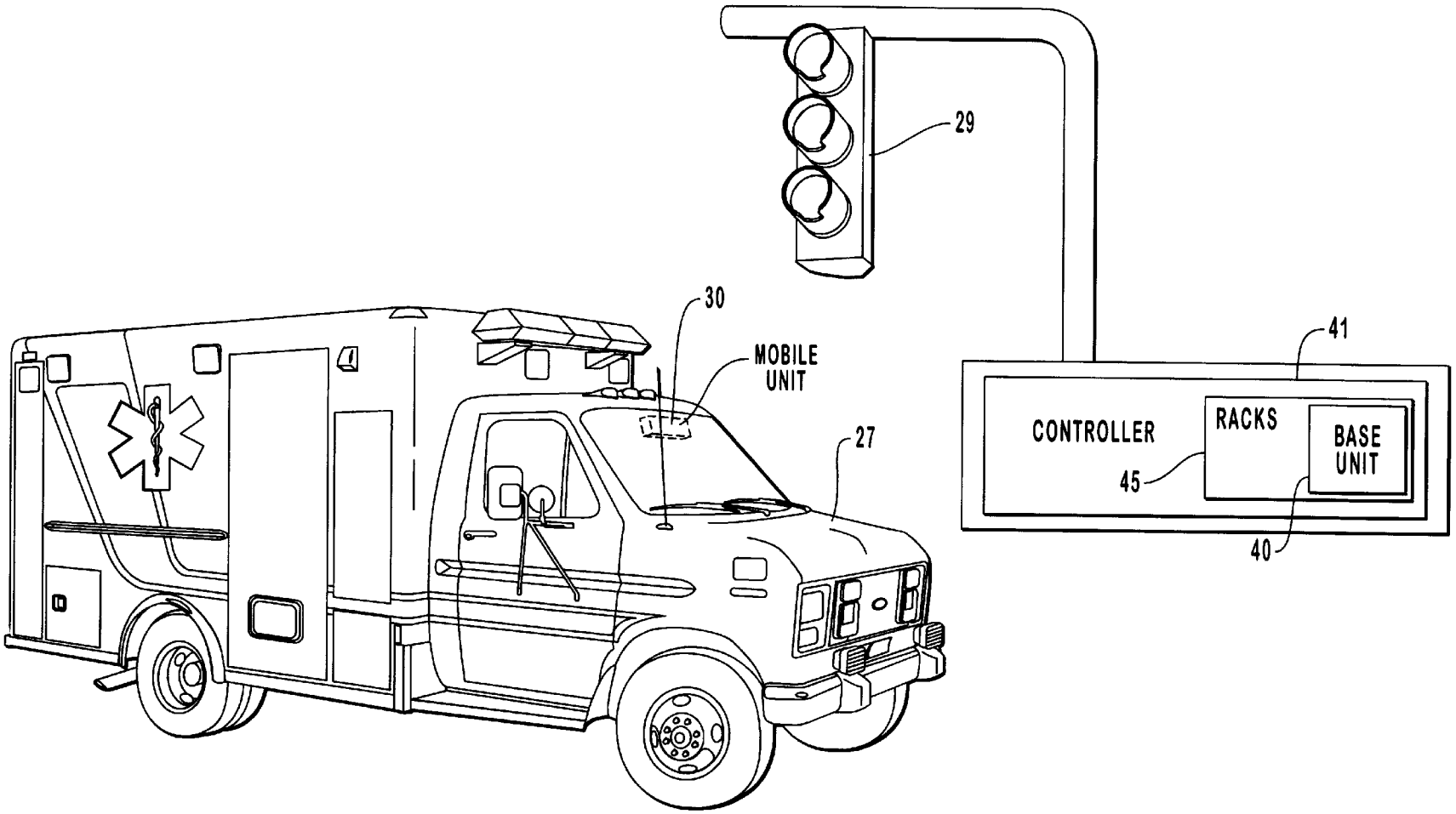
FIG. 2 is a block diagram of a signal light and the system which permits vehicles to preempt the normal operation of the signal light by presenting the operator of an emergency vehicle a green light.

FIG. 2 is an illustration of one embodiment of a system which controls or preempts signal lights. Signal lights 29 at intersection 28 (shown in FIG. 1) are typically controlled and adjusted from a central location, which is controller 41 in this case. Controller 41 is electrically connected to signal lights 29 and allows access to the electrical components and switches which govern the operation of signal lights 29. Controller 41 can be programmed such that signal lights 29 function in a prescribed order. Controller 41 also may comprise an area intended for future uses or additional components or circuitry. In other words, controller 41 has racks 45 which are available for auxiliary equipment. Racks 45 presents inputs which are connected to controller 41 to the attachable auxiliary equipment. Base unit 40 is configured to connect with racks 45 in controller 41. Base unit 40 is capable of interacting with controller 41 such that the signal lights 29 are preempted. In this manner, signal lights 29 present a green light to vehicle 27 in a preferred embodiment.

Mobile unit 30 is mounted in each vehicle 27 and may be in communication with base unit 40. The communication between mobile unit 30 and base unit 40 preferably occurs with high frequency radio waves. The preferred carrier frequency is between 900 MHZ and 925 MHZ. The signals and communication sent between base unit 40 and mobile unit 30 comprise the information necessary for base unit 40 to preempt or control signal lights 29.

Figure 3:
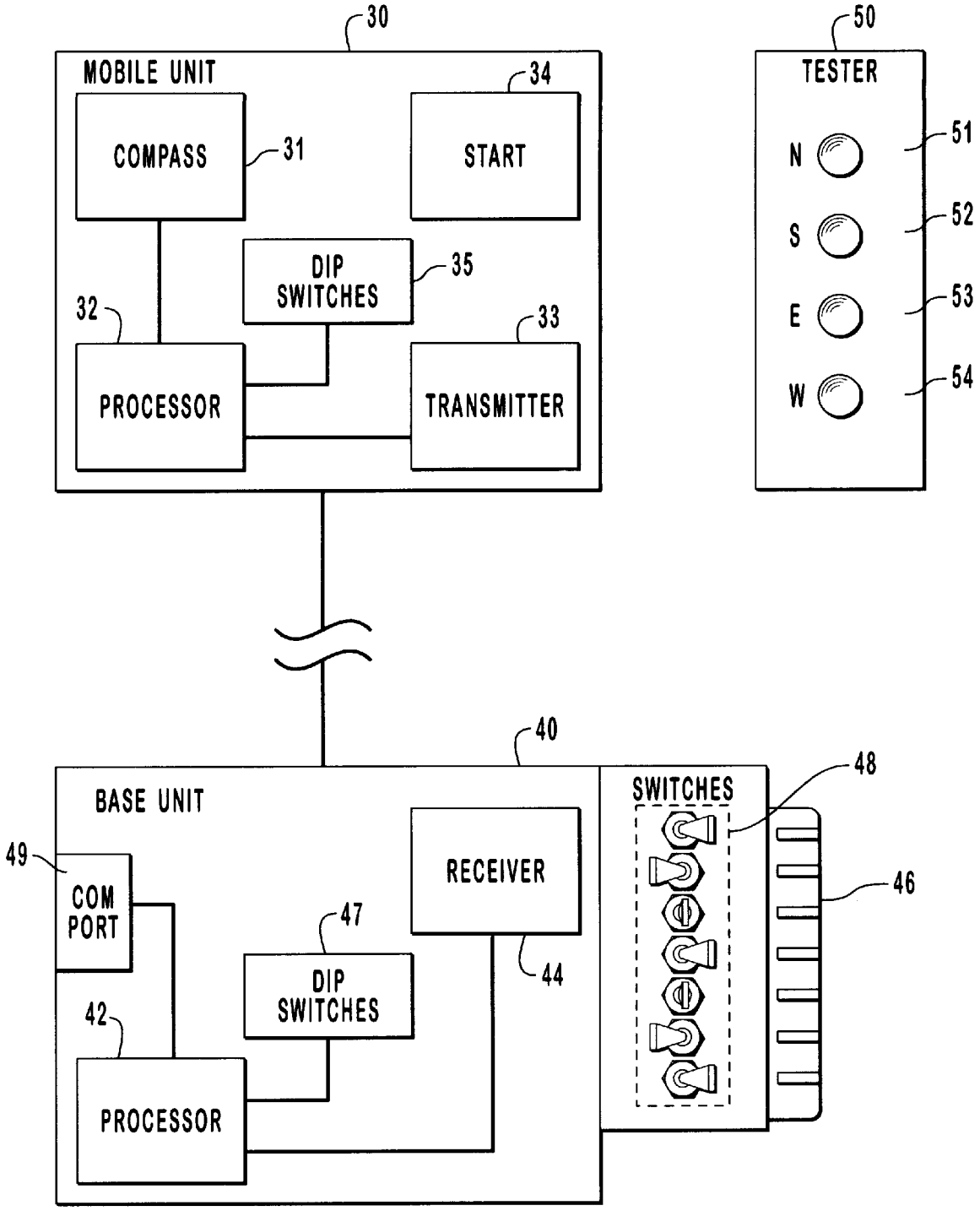
FIG. 3 is a more detailed block diagram of the components of a base unit and a mobile unit which permit a signal light to be preempted.

FIG. 3 is a more detailed block diagram of mobile unit 30 and base unit 40. Each intersection has a base unit 40 and each vehicle which is approved or permitted to preempt signal lights 29 receives mobile unit 30. Mobile unit 30 is typically mounted in vehicle 27 and may be attached to the ceiling, the head board or other appropriate location of vehicle 27. Mobile unit 30 preferably receives electrical power from an auxiliary 12 volt DC output or cigarette lighter of vehicle 27. Alternatively, mobile unit 30 may have its own power supply, Mobile unit also has dip switches 35, which may be used, in one embodiment, to set a caller identification, which will be transmitted to base unit 40.

In one embodiment of the present invention, mobile unit 30 utilizes a level installation in vehicle 27. In this embodiment, liquid level tubes may be provided to aid in the level installation of mobile unit 30. A perfectly level installation is desired, but deviations will not significantly impair the function or operation of mobile unit 30.

Mobile unit 30 comprises compass 31. Preferably, compass 31 is an electronic compass that is sensitive to being level, For this reason, a level installation of mobile unit 30 in vehicle 27 is desired. More specifically, a level installation of compass 31 is preferred while the other components of mobile unit 30 can be oriented in any manner. When mobile unit 30 receives power, compass 31 must be calibrated due to the magnetic interference and distortion which may occur due to the metal of vehicle 27. In one embodiment, compass 31 is calibrated by driving vehicle through 720 degrees or two complete circles, at which point mobile unit 30 can negate the magnetic influence of the metal parts of vehicle 27. Once these calibration constants are found, they are stored by processor 32. Afterwards, the calibration of compass 31 can occur intermittently or when mobile unit 30 is installed in a different vehicle. Compass 31 is an example of means for discriminating the direction of travel of a vehicle, Mobile unit 30 also comprises processor 32. Processor 32 is preferably representative of controllers and microcontrollers and incorporates the necessary hardware and memory necessary to function. Processor 32, however, is also representative of general purpose computers as well as special purpose computers. Processor 32 is capable of receiving data and manipulating the data and can execute computer executable instructions. Other embodiments of processor 32 include a laptop computer which may be electrically connected with compass 31. Embodiments of processor 32 also include computer-readable mediums including EEPROM, RAM, magnetic storage and optical storage devices which may contain computer-executable instructions.

A preferred operation of mobile unit 30 is as follows. When start button 34 is depressed, compass 31 receives power and measures the magnetic field. Once a measurement of the magnetic field has been taken, compass 31 produces an end of calculation signal to processor 32. Processor 32 is programmed to interpret the signals and data produced by compass 31. The data provided by compass 31 is received by processor 32 and stored in memory. This data is corrected according to calibration constants which were previously determined during the calibration of compass 31. Once the data has been corrected, processor 32 converts this data into a magnetic heading. A magnetic heading, in one embodiment, is a direction of travel and may be represented as a degree.

After a magnetic heading is obtained or produced, transmitter 33 is powered and the transmission of data is initiated. Transmitter 33 operates at a high frequency which, in one embodiment, is between about 900 MHZ and 925 MHZ. The high frequency of the transmission has limited range, which effectively permits mobile unit 30 to transmit only to the nearest signal light which vehicle 27 is approaching. The transmission of mobile unit 30 can be accomplished with an omnidirectional antenna, a semi-directional antenna or a directional antenna. In any case, the signal does not reach other base units installed at other intersections because of the frequency and controlled attenuation of the transmitted signal. Thus, intersections or signal lights that the emergency vehicle is not approaching will not be preempted because they are typically too far away from mobile unit 30 and do not receive the transmission. In this preferred manner, only the intersection that the emergency vehicle is approaching and will be traveling through is preempted or controlled.

The data transmitted by transmitter 33 includes: a header which permits receiver 44 to recognize the transmission of transmitter 33; a message identification which is usually a constant; a caller identification which identifies the emergency vehicle and is preferably set using dip switches 35; the magnetic heading; priority data which can be used for example, to identify the type of vehicle; and a checksum used to verify the contents of the transmission. As used herein, all of the information transmitted by mobile unit 30 is referred to as a packet, and at a minimum, a packet contains a magnetic heading of a vehicle. Obviously, the contents of the packet can be altered as desired to include more less or different data.

After the packet has been transmitted, transmitter 33 powers down and the entire process is repeated. This process, as described in this embodiment, is repeated for a preset time period, which can be altered. In one preferred embodiment, each cycle requires approximately 200 to 250 milliseconds, which results in 4 or 5 transmissions per second.

The repeated transmissions are important in many instances because many roads are not straight. Unless the process is repeated, it is possible to preempt the signal lights in a manner resulting in the emergency vehicle not having a green light. The repeated transmissions eliminates this and other concerns.

Base unit 40 has receiver 44 which receives the transmission from transmitter 33. Before the data in the transmission is evaluated and processed, processor 42, which is similar to processor 32, checks the message length and the checksum of the transmission to ensure accuracy. Once the integrity of the transmission is established, the data is evaluated, The magnetic heading in the transmission is received as a degree in this embodiment. Any degree between 315 degrees and 45 degrees is interpreted as North. A magnetic heading between 45 degrees and 135 degrees is interpreted as East. A magnetic heading between 135 degrees and 225 degrees is interpreted as South and a magnetic heading between 225 degrees and 315 degrees is interpreted as West. By way of example and not limitation, the magnetic heading is received and interpreted by base unit 40 as described above.

One potential problem is that the intersection to be preempted is not oriented in a North/South and East/West configuration. To alleviate this problem, processor 42 corrects the magnetic heading based on the physical configuration of the intersection. In other words, the magnetic heading received by processor 42 is adjusted by the degrees which the intersection is offset from a situation where the intersection runs North/South and East/West. In a preferred embodiment, the necessary adjustment is made using a series of dip switches 47 which represent the degrees that the intersection is offset. In this manner, the offset of any intersection is easily provided to processor 42 and base unit 40 may be quickly installed at any intersection.

Another possible problem occurs when emergency vehicles are approaching an intersection from different directions. In one embodiment, the first transmission to be received is granted priority. In another embodiment, the vehicle having the highest priority is allowed to preempt the signal light. If the vehicles have the same priority, then the first to transmit is allowed to preempt the signal lights. In order to prevent the transmissions from two or more emergency vehicles from interfering with each other, the transmitters and receivers may have a plurality of channels, which permits more than one emergency vehicle to communicate with the base unit. In this manner, base unit 40 can handle the transmissions of more than one emergency vehicle. Controller 41, however, typically implements which signal lights to change as well as the order in which they are to be changed upon receiving an output signal from the base unit.

Once the received transmission has received, verified and corrected in accordance with the particular intersection, an output signal is produced which controls the signal lights. For example, if the corrected magnetic heading is a North value, as described above, then an output signal which turns the appropriate signal light green is produced. A similar sequence occurs for a vehicle traveling in a direction interpreted to be South, East or West. The appropriate output signals produced by base unit 40 appear on the outputs 46. Preferably, base unit 40 produces a separate output signal per direction as well as auxiliary outputs for other output signals. Base unit 40 is an example of means for preempting signal lights.

Base unit 40 has a plurality of outputs 46. In a preferred embodiment, base unit 40 has six outputs 46 which connect to controller 41. Controller 41 is designed or can be programmed by the relevant entity to interpret these outputs. In a preferred embodiment, outputs 46 function as follows. Four of the six outputs are used as preemption inputs to controller 41. The magnetic heading is interpreted as being a direction and, depending on the direction, one of the four outputs will be asserted or turned on and controller 41 will cause the appropriate signal light to turn green while the others are turned red. The actual implementation of the preemption scheme is determined by controller 41. Typically, however, only the emergency vehicle will have a green light. The other two outputs are auxiliary outputs and can be adapted to any purpose that is desired by the relevant authority. For example, the auxiliary outputs may be used to determine the priority of the emergency vehicle. If the emergency vehicle has a high priority, then the first auxiliary output may be asserted and if the emergency vehicle has a low priority, then the second output may be asserted.

In other embodiments, the four outputs used to preempt the signal lights can discriminate between a high priority and a low priority vehicle If the output is a steady output signal, it may be interpreted as having a high priority. If the output is a flashing signal, it may be interpreted as having a low priority. In this embodiment, the auxiliary outputs can be used for other purposes.

Additionally, base unit 40 has a communication or com port output 49 which is, in one embodiment, an RS 232 port. This port 49 can be used to transmit data which has been stored in base unit 40. Base unit 40 may store, for example, logging information or other types of information which can sent to a remote location by, for example, a transmitter or modem attached to the com port 49. For example, when a police car passes through an intersection, the location and identity of that police car may be transmitted back to dispatch. Clearly, the use of the outputs can be varied. Base unit 40 can also have fewer or more outputs and ports, but is preferably described herein as having six outputs and a com port.

Outputs 46 are configured to electrically connect to racks 45 as previously described and interact with or override the control signals of the signal lights. Outputs 46 of base unit 40 are preferably fully isolated using opto isolators. Base unit 40 is adaptable to function with the technology of the signal lights. Thus, if the signal light cannot differentiate between a steady output signal and a flashing output signal, then an alternate or separate output is utilized.

FIG. 3 also illustrates tester 50. Tester 50 has, in this embodiment, four LEDs, each of which is indicative of a direction. LED 51 indicates North, LED 52 indicates South, LED 53 indicates East and LED 54 indicates West. Tester 50 functions similarly to base unit 40, but LEDs are used as the outputs. Tester 50 also has LEDs (not shown) which indicate one or more of the following: whether a good signal is being received from mobile unit 30; whether good data is being transmitted; and whether a good power source is present. In this manner, the operator of the vehicle can not only check the information transmitted by mobile unit 30, but also evaluate the operation and function of base unit 40 without interrupting the normal flow of traffic at a particular intersection. It is understood that the LED displayed can be altered to display different information in other embodiments.

Similarly, mobile unit 30 and base unit 40 may also have LED displays. The LED display of mobile unit 30 typically indicates the following: when a good magnetic heading has been calculated and transmission is occurring; when the compass is being calibrated; when good data is being transmitted; and whether a good power source is present. Mobile unit 30 also has some switches. One switch is used to preempt. In other words, this switch is activated when a vehicle desires to preempt the signal lights of an intersection. Mobile unit 30 also has a calibration switch, which is engaged when the compass is being calibrated.

Base unit 40 also has a group of LEDs and switches. Base unit 40 has at least 6 LED indicators (not shown): one for each output signal. Each output LED presented indicates whether the output is active and whether a good signal is being received from mobile unit 30. Bage unit 40 also has an LED indicating the presence of a good power source. Additionally, base unit 40 has switches 48 which are connected to the outputs 46. The switches can be in an on, off or test position. When one or more of switches 48 is in an on position, the output of that particular switch is enabled and waiting for the data which indicates that the output should be asserted such that the signal light control signals are preempted. When switches 48 are in an off position, the preemption ability is disabled. When switches 48 are in a test position, the preemption signals may be manually activated. Switches 48 and LED displays of mobile unit 30 and base unit 40 may also be altered to perform other functions and display other information in other embodiments of the present invention. Additionally, the number of switches and LED indicators can be different in other embodiments.

The present invention has been described in terms of emergency vehicles and signal light preemption, but as mentioned previously, other vehicles can utilize the present invention for other purposes. For instance, the present invention can be used as a tracking mechanism for the mass transit system of a city. The current location of the mass transit vehicles in a city can be tracked. When a bus or other mass transit vehicle is near an intersection, the mobile unit transmits a signal or a packet to the base unit which indicates, in one embodiment, the type of vehicle, the direction of travel and the vehicle identification. Upon receiving the packet from the mobile unit, the base unit can send via the com port logging information which can include the packet and the location of the intersection to dispatch or other remote location. The logging information can contain more or less information as desired. Another use of the present invention is for a taxi service. If the current locations of all taxis are known, then the taxi nearest to the future passenger can be sent to provide a ride to that passenger. Similarly, other types of vehicles can utilize the present invention.

Because the present invention is adaptable to various types of vehicles, the outputs and ports of base unit 40 can be expanded to accommodate other types of vehicles. For that reason, a single base unit at each intersection can functionally accommodate emergency vehicles, mass transit vehicles, taxis and other types of vehicles. In other words, Base unit 40 and mobile unit 30 can be adapted, in one embodiment, to allow emergency vehicles to preempt signal lights and permit a city to track the location of its mass transit vehicles.

Base unit 40 has memory which is capable of storing logging information about various types of vehicles. Logging information can include, but is not limited to, location of the intersection, the type of vehicle entering the intersection, whether preemption was requested, and the direction of travel. Additionally, if a mass transit vehicle or other type of vehicle ever had a need to preempt a signal light and was authorized to do so, then that ability is available.

The present invention may be embodied in other specific forms without departing from its spirit or essential characteristics. The described embodiments are to be considered in all respects only as illustrative and not restrictive The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for controlling passage of one or more vehicles through an intersection having signal lights such that the one or more vehicles may preempt the signal lights, the system comprising:

a mobile unit capable of being mounted in the one or more vehicles, wherein the mobile unit has a compass for measuring a magnetic heading of the one or more vehicles; and a base unit capable of being connected to a controller of the signal lights of the intersection, the base unit being configured to adjust the magnetic heading received from the mobile unit by a number of degrees equal to the number of degrees that the intersection is offset from being aligned in a substantially North/South and East/West configuration, the base unit being configured to produce at least one output signal which is dependent on the adjusted magnetic heading of the one or more vehicles, wherein the at least one output signal is recevied by the controller which preempts the normal operation of the signal lights and causes the signal lights to respond in a prescribed manner to the one or more vehicles.

2. A system as defined in claim 1, wherein each of the one or more vehicles has a mobile unit.

3. A system as defined in claim 1, wherein the mobile unit further comprises:

a mobile processor for processing the magnetic heading produced by the compass; and a transmitter for transmitting the magnetic heading to the base unit.

4. A system as defined in claim 3, wherein the mobile processor produces a packet comprising the magnetic heading, a header, a message identification, a caller identification, priority bits and a checksum.

5. A system as defined in claim 4, wherein the transmitter transmits the packet to the base unit.

6. A system as defined in claim 1, wherein the magnetic heading is repeatedly computed and transmitted to the base unit.

7. A system as defined in claim 1, wherein the base unit further comprises:

a receiver for receiving a transmission from the mobile unit; and a base processor for processing the transmission.

8. A system as defined in claim 7, wherein the transmission comprises the packet.

9. A system as defined in claim 1, wherein the base unit interprets the adjusted magnetic heading as: (i) North if the adjusted magnetic heading is between about 315 degrees and 45 degrees; (ii) East if the adjusted magnetic heading is between about 45 degrees and about 135 degrees; (iii) South if the adjusted magnetic heading is between about 135 degrees and 225 degrees; and (iv) West if the adjusted magnetic heading is between 225 degrees and 315 degrees.

10. A system as defined in claim 1, wherein the mobile unit transmits at a frequency approximately between 900 MHZ and 925 MHZ.

11. A system as defined in claim 1, further comprising a tester, wherein the tester evaluates the function of the base unit and the mobile unit.

12. A system as defined in claim 11, wherein the tester does not interfere with the normal operation of the signal lights.

13. A system as defined in claim 1, wherein the base unit is capable of sending logging information.

14. A system as defined in claim 13, wherein the logging information includes a location of the one or more vehicles and a type of the one or more vehicles.

15. A system as defined in claim 1, wherein the base unit further comprises at least one communication port.

16. A system as defined in claim 15, wherein the at least one communication port is used to transmit the logging information.

17. A system for preempting the signal lights of an intersection for an approaching vehicle, the system comprising:

a mobile unit capable of being mounted in the vehicle, the mobile unit comprising:

a compass for measuring a magnetic heading of the vehicle;

a mobile processor for processing the magnetic heading in preparation for transmission;

a transmitter for transmitting a packet, wherein the packet contains, at a minimum, the magnetic heading; and a base unit comprising:

a receiver for receiving the packet;

a base processor for processing the packet, wherein the magnetic heading is adjusted by a number of degrees equal to the number of degrees that the physical orientation of the intersection is offset from being aligned in a substantially North/South and East/West, the base processor using the adjusted magnetic heading to produce at least one output signal that preempts the signal lights, whereby the signal lights respond in a prescribed manner to the vehicle.

18. A system as defined in claim 17, wherein the packet further comprises: a header byte, a message identification, a caller identification and priority bits.

19. A system as defined in claim 17, wherein the transmitter transmits at a frequency approximately ranging between 900 MHZ and 925 MHZ.

20. A system as defined in claim 17, wherein the magnetic heading is represented in degrees.

21. A system as defined in claim 17, wherein the magnetic heading is repeatedly measured and transmitted.

22. A system as defined in claim 17, wherein the base unit is electrically connected to a controller of the signal lights, wherein the controller receives the at least one control signal and causes the signal lights to be preempted.

23. A system as defined in claim 17, wherein the controller, upon receiving the at least one output signal from the base unit, interrupts the normal operation of the signal lights and causes a green light to be presented to the one or more vehicles.

24. A system as defined in claim 17, further comprising a tester, wherein the tester permits the function and operation of the mobile unit and the base unit to be evaluated without altering the normal operation of the signal lights.

25. A system as defined in claim 17, wherein the base unit further comprises at least one communication port.

26. A system as defined in claim 25, wherein the at least one communication port is used to send logging information to a remote location.

27. A system for preempting the normal operation of a signal light of an intersection to permit one or more emergency vehicles to have the signal light respond to the one or more emergency vehicles in a prescribed manner at the intersection, the system comprising:

a mobile unit capable of being attached to the one or more emergency vehicles, wherein the mobile unit measures a magnetic heading of the one or more emergency vehicles and processes the magnetic heading to produce a packet containing the magnetic heading;

a transmitter for transmitting the packet to a base unit, wherein the base unit processes the packet to retrieve the magnetic heading and adjusts the magnetic heading by a number of degrees equal to the number of degrees that the intersection is offset from being aligned in a substantially North/South and East/West configuration, the base unit being configured to produce at least one output signal which preempts the signal light such that the signal light responds in a prescribed manner to the one or more emergency vehicles.

28. A system as defined in claim 27, wherein the mobile unit further comprises:

a compass which measures the magnetic heading of the one or more emergency vehicles; and a mobile processor which receives the magnetic heading from the compass and processes the heading to account for the magnetic error caused by the one or more vehicles.

29. A system as defined in claim 27, wherein the mobile unit repeatedly measures the magnetic heading, processes the magnetic heading, produces a packet and transmits the packet to the base unit.

30. A system as defined in claim 29, wherein the packet is produced and transmitted approximately 5 times per second.

31. A system as defined in claim 27, wherein the base unit comprises a receiver for receiving the packet from the transmitter.

32. A system as defined in claim 27, wherein the base unit comprises a base processor for processing the packet.

33. A system as defined in claim 32, wherein the base processor alters the magnetic heading contained in the packet to account for the physical orientation of the intersection being preempted by the one or more vehicles.

34. A system as defined in claim 27, wherein the packet further comprises: a header byte, a message identification, a caller identification and priority bits, and a checksum.

35. A system as defined in claim 27, wherein only the intersection nearest the one or more vehicles is preempted.

36. A system as defined in claim 27, further comprising a tester, wherein the tester tests the operation and function of the mobile unit and the base unit without interfering with the normal operation of the signal lights.

37. A system as defined in claim 27, wherein the base unit further comprises one or more communication ports.

38. A system as defined in claim 37, wherein at least one of the one or more communication ports is used to transmit logging information to a remote location.

39. A method for preempting signal lights at an intersection, the method comprising the steps of:

measuring a magnetic heading of one or more vehicles;

transmitting the magnetic heading to a base unit installed at the intersection to be preempted;

altering the magnetic heading at the base unit to account for the physical orientation of the intersection by adjusting the magnetic heading of the one or more vehicles by a number of degrees equal to the number of degrees that the intersection is offset from being aligned in a substantially North/South and East/West configuration; and producing at least one control signal according to the adjusted magnetic heading which preempts the signal lights and causes the signal lights to respond in a prescribed manner to the one or more vehicles.

40. A method as defined in claim 39, wherein the step of measuring a magnetic heading further comprises the step of altering the magnetic heading to account for the metal of the one or more vehicles.

41. A method as defined in claim 39, wherein the step of transmitting the magnetic heading further comprises the step of transmitting: a header byte, a message identification, a caller identification, priority data, and a check sum.

42. A computer-readable medium having computer-executable instructions for executing the steps recite in claim 39.

43. A system for controlling the signal lights of an intersection comprising:

a mobile unit comprising:

means for discriminating a direction of travel of a vehicle; and a transmitter for transmitting a transmission which includes the direction of travel of the vehicle; and a base unit comprising:

a receiver for receiving the transmission;

a processor in communication with a plurality of dip switches configured to adjust the direction of travel of the vehicle received from the mobile unit by a number of degrees equal to the number of degrees that the intersection is offset from being aligned in a substantially North/South and East/West configuration; and means for preempting signal lights, whereby the signal lights respond in a prescribed manner to the vehicle at the intersection.

44. A system as defined in claim 43, wherein the means for discriminating a direction of travel comprises a compass.

45. A system as defined in claim 44, wherein the means for discriminating a direction of travel further comprises a mobile processor which processes the direction of travel to account for the magnetic influence of the vehicle.

46. A system as defined in claim 43, wherein the transmission further includes caller identification and priority data.

47. A system as defined in claim 43, wherein the one or more dip switches represent the degree that the intersection is offset from the substantially North/South and East/West configuration.

48. A system as defined in claim 43, wherein the means for preempting the signal lights produces at least one control signal which is interpreted by a controller of the intersection such that the signal lights are preempted.

49. A system as defined in claim 43, wherein the means for preempting the signal lights further comprises at least one communication port, wherein at least one of the at least one communication port is capable of transmitting logging information to a remote location.

50. A system for tracking at a remote location one or more vehicles, the system comprising:

a mobile unit capable of being mounted in the one or more vehicles, the mobile unit comprising:

a compass for measuring a magnetic heading of the one or more vehicles;

a transmitter for transmitting a packet, wherein the packet contains, at a minimum, the magnetic heading; and a base unit comprising:

a base processor for processing the packet, wherein the magnetic heading is adjusted by a number of degrees equal to the number of degrees that the intersection is offset from being aligned in a substantially North/South and East/West configuration, such that a direction of travel of the one or more vehicles is known; and at least one communication port, wherein the at least one communication port is used to transmit information representative of at least one of the one or more vehicles and the intersection to the remote location.

51. A system as defined in claim 50, wherein the packet further comprises information selected from the group consisting of (i) the type of the one or more vehicle; (ii) physical orientation of the intersection; and (iii) a vehicle identification.

52. A system as defined in claim 50, wherein the logging information comprises: the packet, and the location of the intersection.

53. A system for tracking one or more vehicles, the system comprising:

a mobile unit capable of being attached to the one or more vehicles, wherein the mobile unit measures a magnetic heading of the one or more vehicles and processes the magnetic heading to produce a direction of travel;

a processor for producing a packet comprising, at a minimum, the direction of travel, a type of vehicle, and an identification of the one or more vehicles;

a mobile transmitter for transmitting the packet to a base unit, wherein the base unit comprises at least one communication port;

a base processor for processing the direction of travel to obtain the magnetic heading and adjusting the magnetic heading received from the mobile unit by a number of degrees equal to the number of degrees that the intersection is offset from being aligned in a substantially North/South and East/West configuration, the base unit being configured to produce logging information, wherein the logging information comprises, at a minimum, the packet and the location of an intersection; and a base transmitter connected to the at least one communication port, for transmitting the logging information to a remote location, whereby the one or more vehicles are tracked.

54. A system as defined in claim 53, wherein the vase unit produces one or more output signals capable of preempting a signal light.

* * * * *